US009631427B2

(12) United States Patent
Vandermillen et al.

(10) Patent No.: US 9,631,427 B2
(45) Date of Patent: Apr. 25, 2017

(54) DOOR CURTAINS WITH POSITION SENSOR SWITCHES

(71) Applicants: Daniel Vandermillen, Dubuque, IA (US); Ryan P. Beggs, Dubuque, IA (US)

(72) Inventors: Daniel Vandermillen, Dubuque, IA (US); Ryan P. Beggs, Dubuque, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 9 days.

(21) Appl. No.: 14/742,009

(22) Filed: Jun. 17, 2015

(65) Prior Publication Data

US 2016/0369557 A1 Dec. 22, 2016

(51) Int. Cl.
*E06B 9/68* (2006.01)
*E06B 9/70* (2006.01)

(52) U.S. Cl.
CPC ..... *E06B 9/68* (2013.01); *E06B 9/70* (2013.01); *E05Y 2400/32* (2013.01);
(Continued)

(58) Field of Classification Search
CPC ..... E06B 9/68; E06B 9/70; E06B 2009/6818; E06B 2009/6845; E06B 2009/689; E05Y 2400/445; E05Y 2400/854; E05Y 2400/32
See application file for complete search history.

(56) References Cited

U.S. PATENT DOCUMENTS 5,353,859 A * 10/1994 Oltahfer ..... E05B 47/0002 160/291
6,082,433 A 7/2000 Vafaie et al.
(Continued)

FOREIGN PATENT DOCUMENTS

DE 102006015507 10/2007
WO 2013067549 5/2013

OTHER PUBLICATIONS

International Searching Authority, "Written Opinion," issued in connection with PCT Application No. PCT/US2016/037175, mailed Sep. 14, 2016, 6 pages.
(Continued)

*Primary Examiner* — Blair M Johnson
(74) *Attorney, Agent, or Firm* — Hanley, Flight & Zimmerman, LLC

(57) ABSTRACT

Door curtains with position sensor switches are disclosed. An example door for selectively blocking and unblocking a passageway includes a frame to be adjacent the passageway. The example door includes a curtain moveable selectively to a closed position and a first open position, where the curtain blocks the passageway in the closed position, and the curtain unblocks the passageway in the first open position. The example door also includes a bracket to be attached to the frame. The bracket is movable selectively to a normal position and a displaced position relative to the frame. The example door further includes a switch to be attached to the bracket and in sensing relationship with the curtain. The curtain supports at least some weight of the bracket when the bracket is in the displaced position. The curtain supports no weight of the bracket when the bracket is in the normal position.

23 Claims, 6 Drawing Sheets

(52) U.S. Cl.
CPC ... *E05Y 2400/445* (2013.01); *E05Y 2400/854* (2013.01); *E06B 2009/689* (2013.01); *E06B 2009/6818* (2013.01); *E06B 2009/6845* (2013.01)

(56) References Cited

U.S. PATENT DOCUMENTS

| | | | | |
|---|---|---|---|---|
| 6,145,571 | A | 11/2000 | Snyder | |
| 8,746,321 | B2 * | 6/2014 | Miller | E06B 9/15 160/310 |
| 2006/0113935 | A1 | 6/2006 | Angiuli et al. | |
| 2013/0112354 | A1 * | 5/2013 | Hardison, III | E06B 9/581 160/127 |
| 2013/0112358 | A1 * | 5/2013 | Hardison, III | E06B 9/86 160/340 |
| 2014/0345812 | A1 * | 11/2014 | Casey | E06B 9/581 160/273.1 |

OTHER PUBLICATIONS

International Searching Authority, "International Search Report," issued in connection with PCT Application No. PCT/US2016/037175, mailed Sep. 14, 2016, 6 pages.

* cited by examiner

FIG. 6
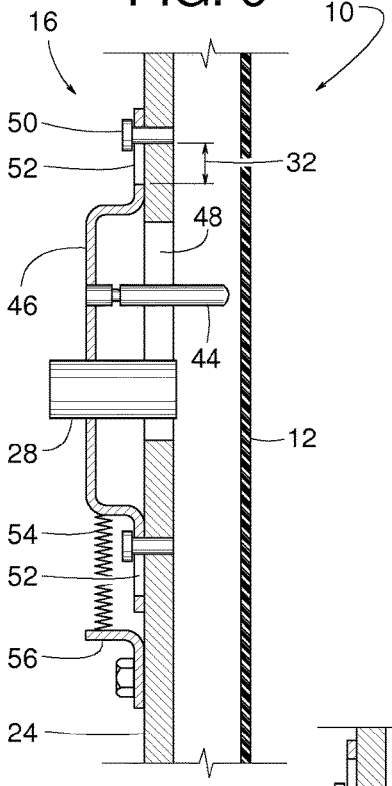
FIG. 7
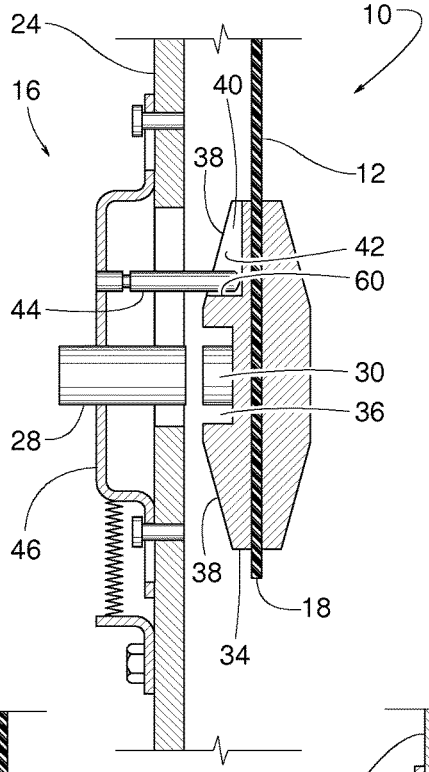
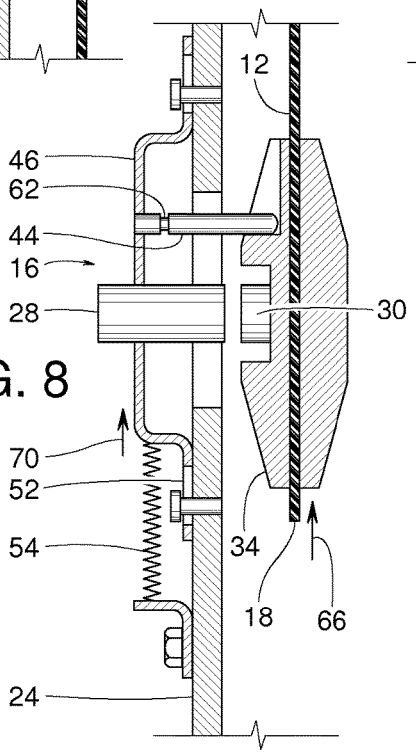
FIG. 8
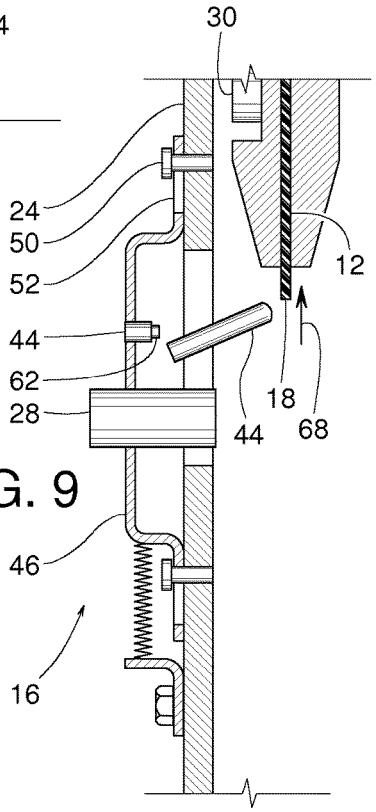
FIG. 9

DOOR CURTAINS WITH POSITION SENSOR SWITCHES

FIELD OF THE DISCLOSURE

This patent generally pertains to powered door curtains and more specifically to door curtains with position sensor switches.

BACKGROUND

Some powered doors have a pliable panel or curtain that moves vertically or horizontally to open or block a doorway or other passageway. Various sensors can be used for determining whether the door is open or closed. Examples of doors that have a pliable panel or curtain include planar doors, overhead-storing doors and roll-up doors.

Planar doors have a curtain that remain generally planar as the curtain, guided by tracks, translates between open and closed positions. Some planar doors have wheels, trolleys or sliding members that couple the curtain to the tracks.

Overhead-storing doors are similar to many conventional garage doors in that overhead-storing doors have guide tracks that curve between a vertical section alongside the doorway and a horizontal section above the doorway. To open and close the door, the curtain travels to the horizontal and vertical sections, respectively.

A roll-up door comprises a curtain that when the door is open the curtain is wound about a roller or otherwise coiled beyond the perimeter of the doorway. To close the door, the curtain unwinds as two tracks guide the curtain across the doorway. Roll-up doors are typically either powered open and closed or are powered open and allowed to fall closed by gravity.

BRIEF DESCRIPTION OF THE DRAWINGS

FIG. 6 is a cross-sectional view taken along line 6-6 of FIG. 1.

FIG. 7 is a cross-sectional view taken along line 7-7 of FIG. 3.

FIG. 8 is a cross-sectional view taken along line 8-8 of FIG. 4.

FIG. 9 is a cross-sectional view taken along line 9-9 of FIG. 5.

DETAILED DESCRIPTION

Example powered doors having a movable curtain for selectively opening and blocking a doorway or other passageway include a sensor for detecting whether the curtain reaches a first open position. In some examples, a vertically sliding bracket connects the sensor near the upper end of a stationary frame of the door. If momentum carries the curtain upward beyond the first open position to a slightly higher second open position, the sliding bracket follows the curtain's movement to automatically maintain substantial alignment of the sensor and a corresponding actuator. In this manner, the sensor can still detect that the door is open regardless of whether the curtain stops at the first or second open position or anywhere in between. In some examples, the movement of the curtain is what moves the bracket from the first to second open position. In some examples, the bracket includes a shear pin that breaks away if the curtain travels above the second open position.

Figure 1:
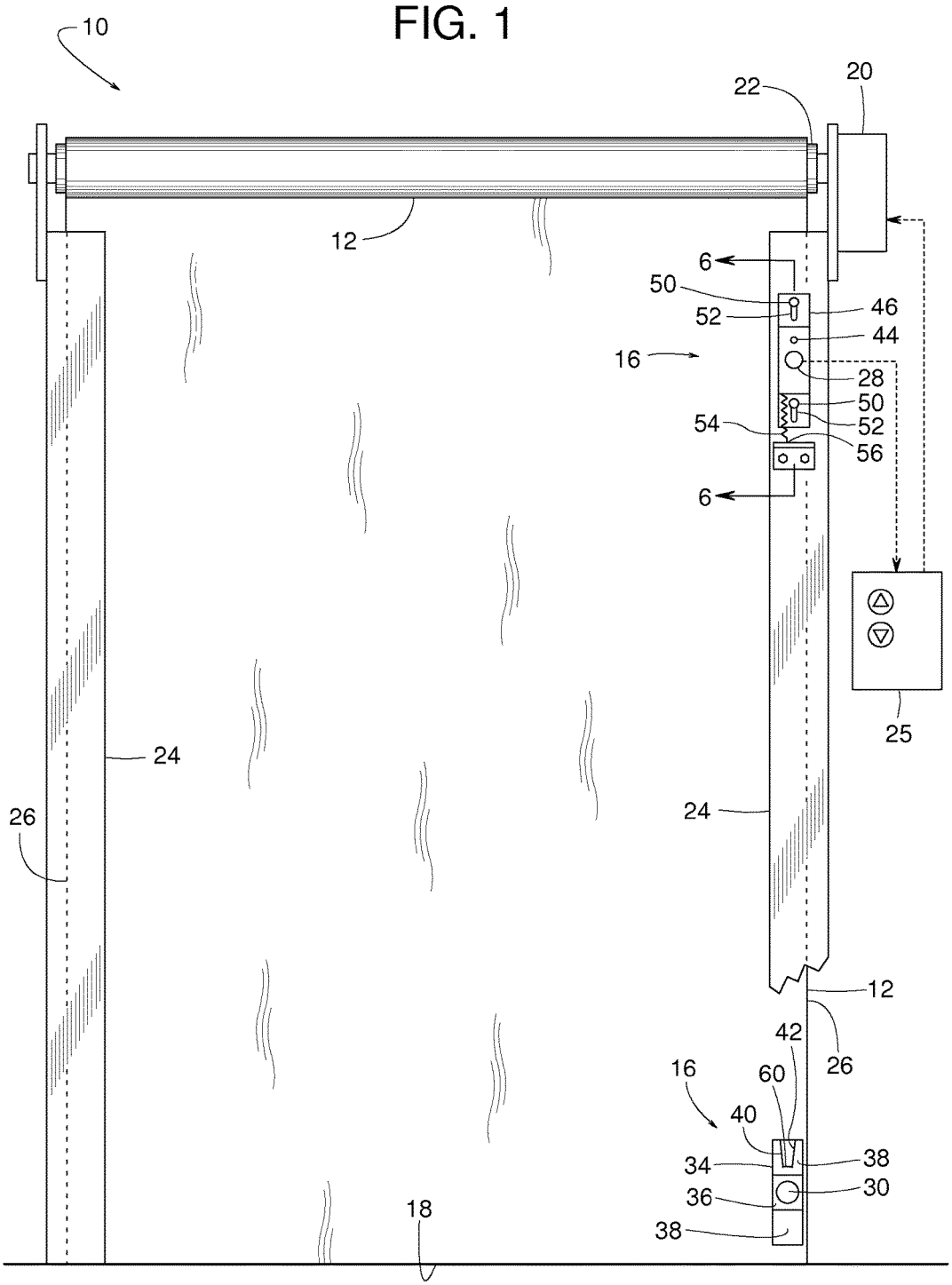
FIG. 1 is a front view and partial cut-away of an example door constructed in accordance with the teachings disclosed herein, wherein the example door is at a closed position.
Figure 2:
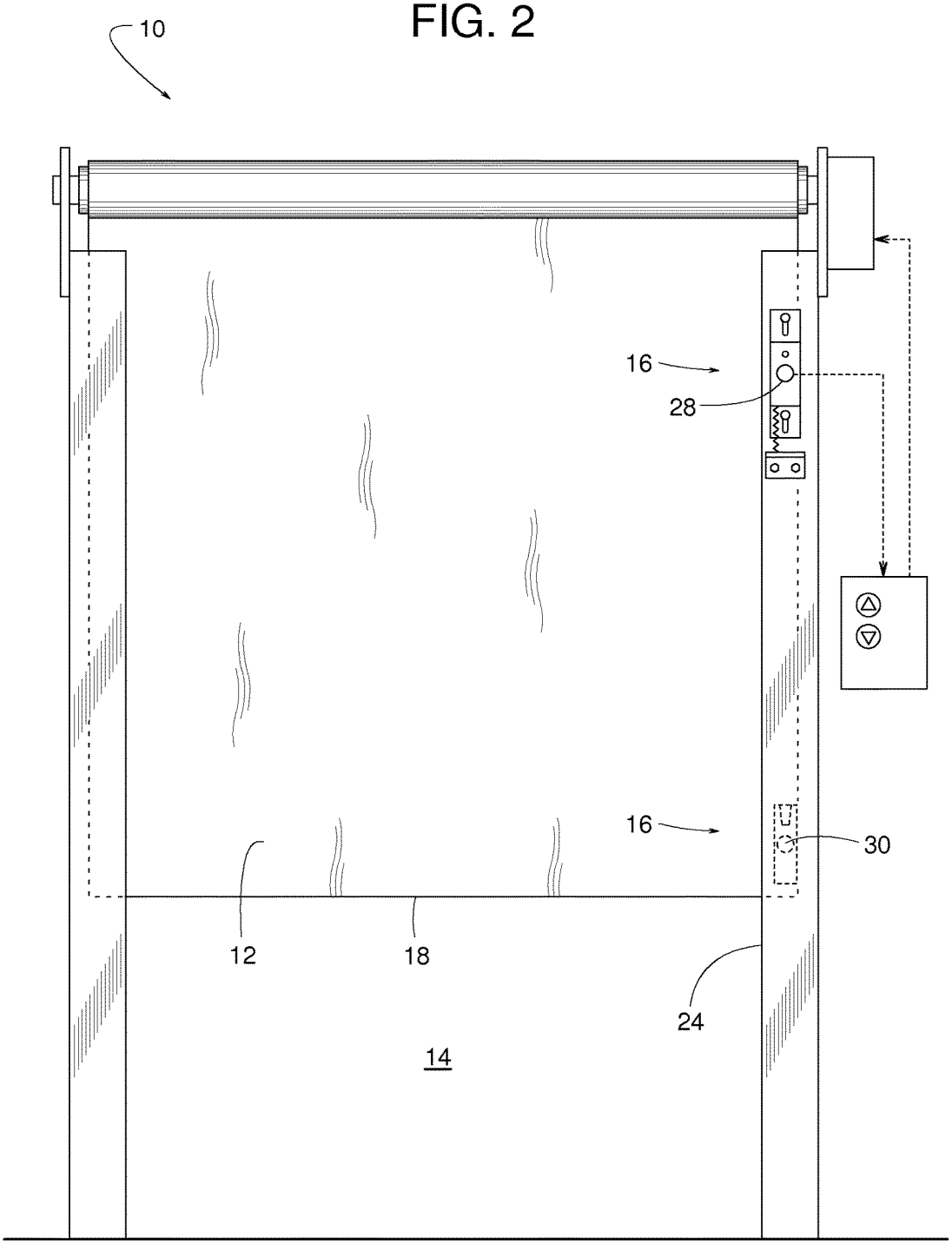
FIG. 2 is a front view similar to FIG. 1 but showing the example door at a partially open position.
Figure 3:
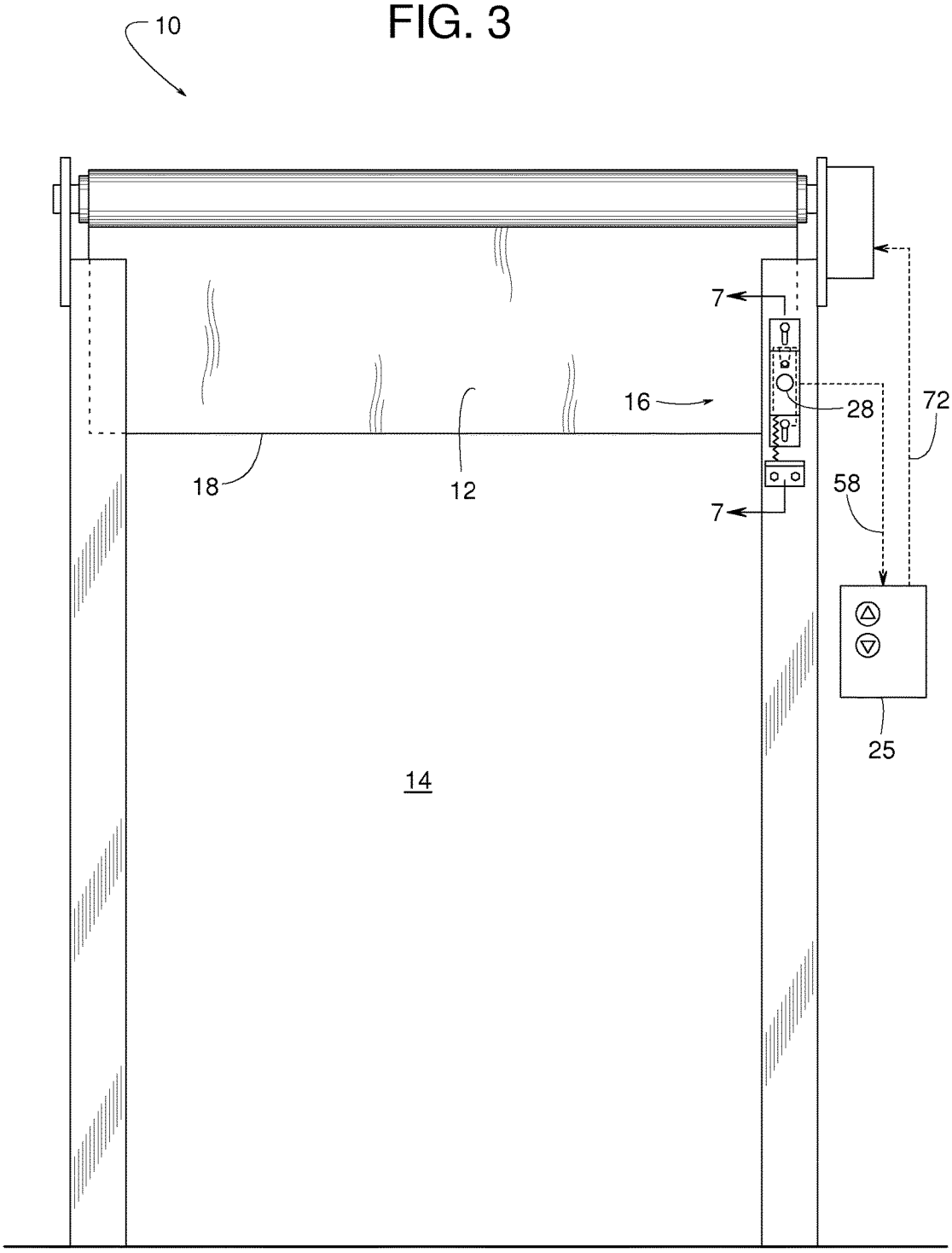
FIG. 3 is a front view similar to FIG. 1 but showing the example door at a first open position.
Figure 4:
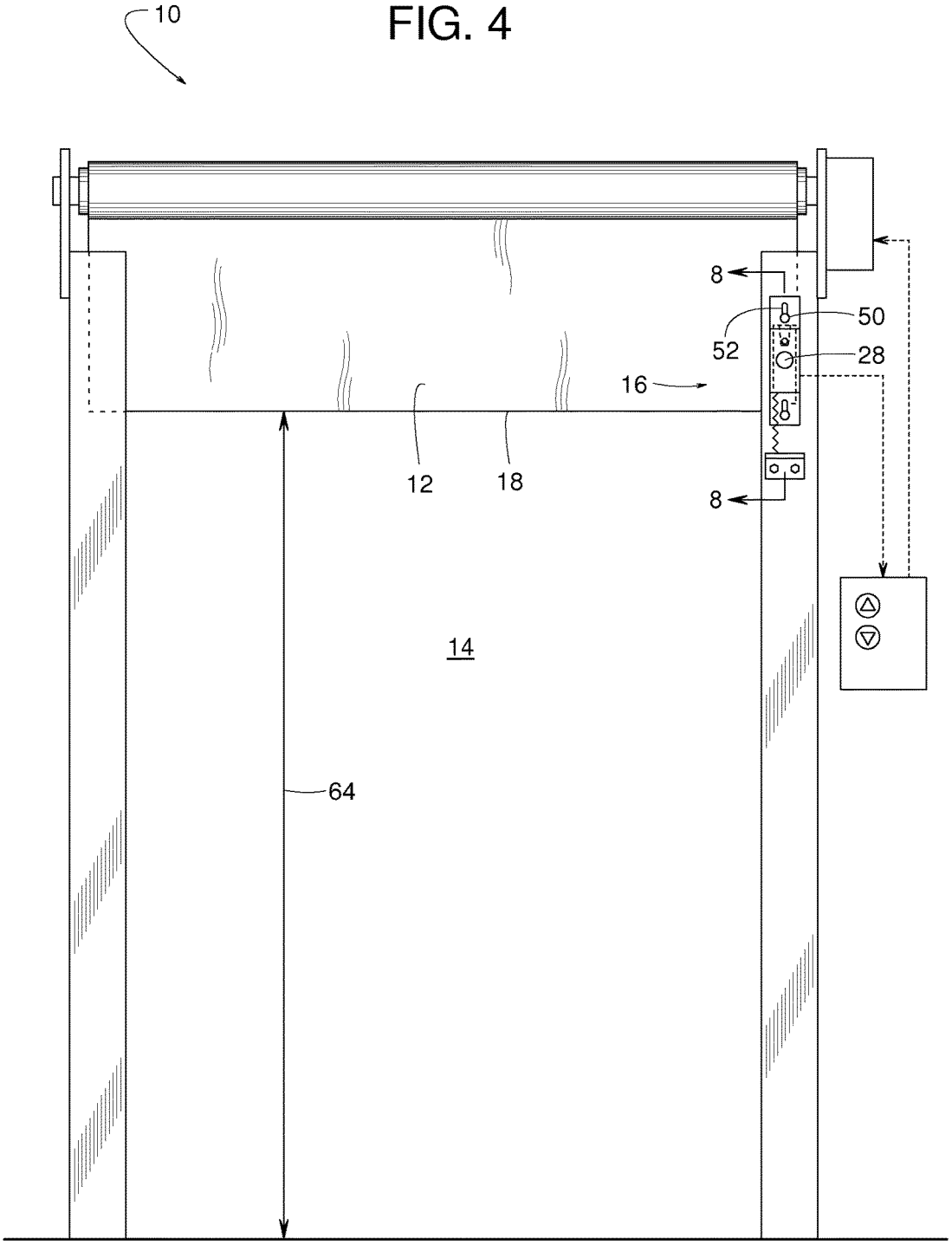
FIG. 4 is a front view similar to FIG. 1 but showing the example door at a second open position.
Figure 5:
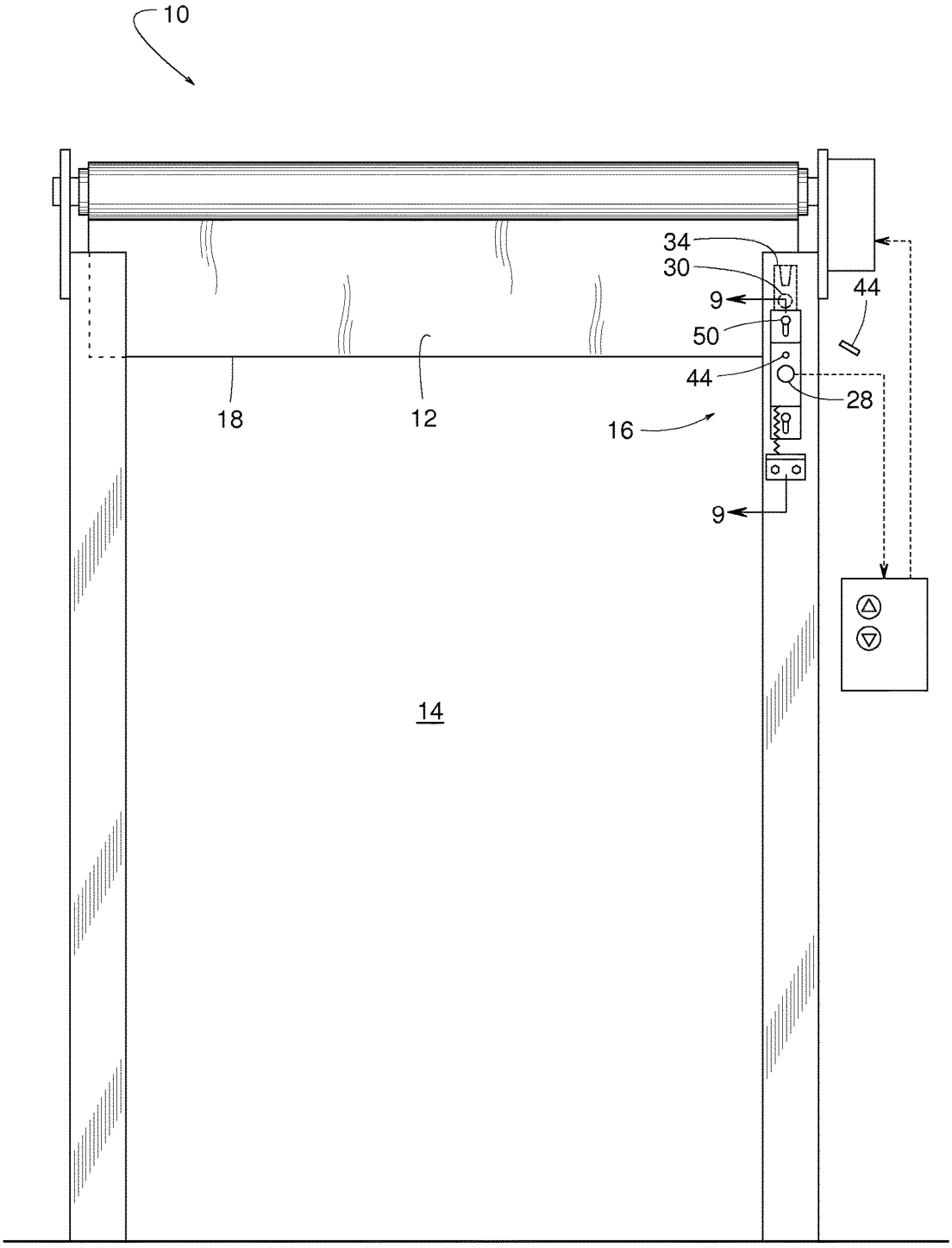
FIG. 5 is a front view similar to FIG. 1 but showing the example door at an overshot position.

FIGS. 1-9 show an example door 10 with a curtain 12 movable across a passageway 14. The door 10 includes door sensing assembly 16 for detecting when the curtain 12 is at a first open position (FIGS. 3 and 7), detecting when the curtain 12 is at a second slightly further open position (FIGS. 4 and 8), and yielding to the curtain 12 upon the curtain 12 moving to an overshot position (FIGS. 5 and 9). FIG. 1 shows the curtain 12 at a closed position blocking the passageway 14, and FIG. 2 shows the curtain 12 partially open. The term, "passageway" refers to any opening through which something can pass. Examples of the passageway 14 include a doorway leading to a building space, an access opening leading to machinery, etc.

In the example shown in FIGS. 1-9, the curtain 12 has a leading edge 18 that moves down to close the door 10. In other examples, the door 10 is inverted with the leading edge 18 moving upward to close. In still other examples, the door 10 operates sideways with the curtain's leading edge 18 moving horizontally to open or close.

To operate the door 10, in the illustrated example, the door 10 includes a motorized drive unit 20 comprising a motor rotating a drum or roller 22 about which the curtain 12 is wrapped and unwrapped as the door 10 opens and closes. Depending on the direction of rotation, as determined by a controller 25, the drum 22 selectively draws the curtain 12 up to uncover the passageway 14 or pays the curtain 12 out to lower the curtain 12 across the passageway 14. In some examples, when lowering the curtain 12, the roller 22 controllably releases the curtain 12 while the curtain's weight helps pull the curtain 12 downward. In some examples, to help guide the curtain's vertical movement, the door 10 includes a frame 24 that serves as a guide track for guiding the curtain's lateral edges 26. In some examples of the door 10, the frame 24 flanks the passageway 14, and a separate track guides the curtain's lateral edges 26.

In the illustrated example, as the curtain's leading edge 18 moves from its closed position (FIG. 1) to its first open position (FIGS. 3 and 7) or continues farther to a second open position (FIGS. 3 and 8), the door sensing assembly 16 responds effectively to sense that the door 10 is open in either case. In the illustrated example, the door sensing assembly 16 includes a switch 28 attached to the frame 24 near the upper end of the door 10, and a corresponding the switch actuator 30 attached to the curtain 12 near the curtain's leading edge 18. The switch 28 is schematically illustrated to represent any electrical device that can be triggered to change from one electrical state to another and can provide some feedback indicating the state. It the illustrated example, when the curtain 12 opens and brings the actuator 30 into substantial alignment with the switch 28, as shown in FIGS. 3, 4, 6 and 7, the actuator 30 triggers the switch 28 from a normal state (e.g., normally open contacts, normally closed contacts, a certain electrical signal, etc.) to a triggered state (opposite to or at least distinguishable from the normal state). As used herein in relation to the actuator 30 and the switch 28, the phrases "substantial alignment" or "substantially aligned" means the actuator 30 is sufficiently close to the switch 28 to activate and/or trigger the switch 28. In some examples, the switch 28 is a proximity switch that remains spaced apart from the switch actuator 30 regardless of whether the position of the curtain 12. In some examples, the switch 28 is a model Adam P/N 2051-xx provided by Jokab Safety of Westland, Mich., and the switch actuator 30 is a model Eva P/N 20-046-xx also provided by Jokab Safety. Some alternate examples of the switch actuator 30 include a magnet, a ferrous block, a reflector (e.g., a barcode, white mark, reflective paint, mirror), and an RFID device. Such alternate actuator examples would, of course, be paired with a corresponding compatible switch.

In some examples, the switch actuator 30 is substantially fixed relative to its mounting surface on the curtain 12, while the switch 28 is mounted with some float or a limited range of travel 32 (FIG. 6) along the frame 24. The limited range of travel 32 allows the switch 28 to stay substantially aligned with the actuator 30 as the curtain's leading edge 18 moves past its first open position (FIG. 7) to its second further open position (FIG. 8).

In the illustrated example, the switch actuator 30 is mounted to a carrier 34, which in turn is attached to the curtain 12. To prevent the carrier 34 and the actuator 30 from becoming snagged on the track 24 or catching on any other adjacent surfaces, the actuator 30 sits within a recess 36 of the carrier 34, and beveled surfaces 38 are along the carrier's leading and trailing edges. The carrier 34 also has a groove 40 with a tapered lead-in guide surface 42 for receiving and guiding an alignment member 44 associated with the switch 28.

In some examples, the switch 28 and the alignment member 44 are attached to a bracket 46 and extend through an opening 48 in the frame 24. In some examples, the fasteners 50 extend through elongate slots 52 in the bracket 46 to fasten the bracket 46 in sliding relationship with the frame 24. In some such examples, the opening 48 provides travel clearance for the switch 28 and the alignment member 44 to move with the bracket 46 relative to the frame 24 along the limited range of travel 32 between a normal position of the bracket 46 (FIGS. 1-3, 5-7 and 9) and a displaced position of the bracket 46 (FIGS. 5 and 8). Gravity and/or a spring 54 extending between the bracket 46 and an anchor point 56 urges the bracket 46 (along with the switch 28 and the alignment member 44) toward the normal position.

In some examples, when the curtain 12 opens from its closed position (FIGS. 1 and 6) to its first open position (FIGS. 3 and 7), the alignment member 44 slides into the groove 40 to substantially align the switch actuator 30 with the switch 28. In some examples, the proximity of the switch 28 with the actuator 30 triggers the switch 28 from its normal state to its triggered state. In the triggered state of the illustrated example, the switch 28 provides a signal 58 that tells the controller 25 that the door 10 is open. The switch 28 is in its normal state in the illustrated example when the actuator 30 is misaligned with the switch 28 such as, for example, when the curtain 12 is at a closed position (FIG. 1) or is at a partially open position (FIG. 2). Thus, in some examples, the switch 28 is in a sensing relationship with the curtain 12. The expression, "in sensing relationship with the curtain," as it relates to a switch, means that the switch responds to the position of the curtain by enabling the detection of some feature associated with the curtain.

If momentum carries the curtain 12 beyond the first open position (FIGS. 3 and 7) to the second open position (FIGS. 4 and 8), the switch 28 remains in the triggered state because the door sensing assembly 16 keeps the actuator 30 substantially aligned with the switch 28. More specifically, as the curtain 12 moves from the first open position to the second open position, the carrier 34 lifts the alignment member 44 so that the actuator 30 and the switch 28 rise together. Upon the carrier 34 lifting the alignment member 44, the curtain 12 supports at least some of the weight of the bracket 46 and/or the switch 28. In the closed position, the curtain 12 supports none of that weight. The curtain 12 being able to selectively carry and release the weight of the bracket 46 and/or the switch 28 makes it possible for the door sensing assembly 16 to distinguish a plurality of open positions (e.g., spanning the limited range of travel 32) from a closed position. In some examples, a lower edge 60 of the groove 40 engaging the alignment member 44 is what enables the carrier 34 to lift the alignment member 44, the bracket 46 and the switch 28.

If the curtain 12 rises to an overshot position above the second open position and lifts the alignment member 44 beyond the bracket's limited range of travel 32, as shown in FIGS. 5 and 9, some examples of the alignment member 44 breakaway from an intact configuration (e.g., FIG. 8) to a broken configuration (FIG. 9), thereby preventing damage to other more expensive parts of the door 10. The alignment member 44 having a breakaway function means that in response to the curtain 12 traveling to the overshot position, the alignment member 44 will yield or breakaway before the bracket 46 and the curtain 12 break. In some examples, the alignment member 44 is a shear pin, which is a cylinder piece having a predetermined weak spot 62.

In some examples, the bracket's limited range of travel 32 is defined by the limited distance that the fasteners 50 can slide along the slots 52. It is important to note that the bracket's limited range of travel 32 is significantly less than the curtain's total range of travel. In other words, the curtain's leading edge 18 has a first full travel range 64 that is greater than a second full travel range (i.e., limited range of travel 32) of the switch 28. Otherwise, the switch 28 might travel the full distance of the curtain 12 and provide no meaningful reference to a properly open position.

For further clarification, it should be noted that the term, "curtain" refers to a sheet of material (single or multi-layer) that when positioned along a generally vertical plane, the sheet of material offers substantially inconsequential vertical support in that the sheet of material when unsupported along its vertical length tends to buckle or collapse under its own weight. Examples of the curtain 12 include one or more layers of fabric, one or more layers of pliable polymeric sheeting, a flexible screen, etc. An arrow 66 represents moving the curtain 12 from the first open position to the second open position. The term, "partially open" refers to the curtain 12 being neither fully closed nor fully open. An arrow 68 represents moving the curtain 12 to the overshot position. An arrow 70 represents the curtain 12 moving the bracket 46 from the normal position to the displaced position (e.g., via the carrier 34). The alignment member 44 being shown in FIG. 9 as two separate pieces represents breaking the alignment member 44 upon the curtain 12 moving from the second open position to the overshot position. The term, "motorized drive unit," as it pertains to a curtain, means any powered apparatus able to raise or lower a curtain in response to a controller. Examples of the motorized drive unit 20 include a motor driven drum (including, for example, a drum rotated by an electric motor, a hydraulic motor or a pneumatic motor), a winch, a hoist, and a linear actuator (e.g., linear motor, motor driven lead screw, hydraulic cylinder, pneumatic cylinder, etc.). The term, "controller" refers to any electrical system with one or more components for providing certain outputs (e.g., a motor on/off signal 72) in response to certain inputs (e.g., the signal 58). Examples of the controller 25 include, but are not limited to, a computer, a programmable logic controller (PLC), electrical circuit, electromechanical relays, and various combinations thereof.

Example doors other than the door 10 of the illustrated example may additionally or alternatively be implemented in accordance with the teachings disclosed herein. For instance, in some examples, the sensing assembly 16 may be positioned at a different location along the length of the frame 24 to correspond to a different location where the leading edge 18 of the curtain 12 is to be stopped. For example, the sensing assembly 16 may be mounted to the frame 24 near the leading edge 18 of the curtain in a partially open position (e.g., as represented in FIG. 2). In some such examples, the orientation of the sensing assembly 16 depends upon the direction in which the curtain 12 is expected to be travelling before stopping at the partially closed position. For example, if the curtain 12 is to move from the closed position (as in the illustrated example of FIGS. 1-9) to a stopping point at the partially open position, the sensing assembly 16 may be oriented in the same manner as in the illustrated example. That is, in such examples, the normal position of the bracket 46 is closer to the closed position than the displaced position; and both the normal and displaced positions are closer to the closed position than an overshot position. In other examples, where the curtain 12 is to move from a fully open position and then stop at the partially open position, the sensing assembly 16 may be inverted relative to the illustrated example. In other examples, the sensing assembly 16, the sensing assembly 16 is located at or near the base of the frame 24 to detect when the leading edge 18 is at or near the closed position (e.g., as represented in FIG. 1). Further, as mentioned above, in some examples, the door 10 operates sideways with the curtain's leading edge 18 moving horizontally to open or close. In such examples, the sensing assembly 16 may be oriented sideways (e.g., on a track extending along a top portion of the door 10) to sense when the curtain 12 is in a designated stopping position. Some horizontally opening and closing doors include two separate panels or curtains. In some such examples, each curtain may have a separate sensing assembly.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. A door for selectively blocking and unblocking a passageway, the door comprising:

a frame to be adjacent the passageway;

a curtain moveable selectively to a closed position and a first open position, the curtain blocking the passageway in the closed position, and the curtain unblocking the passageway in the first open position;

a bracket to be attached to the frame, the bracket being movable selectively to a normal position and a displaced position relative to the frame; and a switch to be attached to the bracket and in sensing relationship with the curtain, the switch to move with the bracket between the normal position and the displaced position, the curtain supporting at least some weight of the bracket when the bracket is in the displaced position, the curtain supporting no weight of the bracket when the bracket is in the normal position.

2. The door of claim 1, wherein the bracket moves between the normal position and the displaced position in response to movement of the curtain.

3. The door of claim 1, wherein the curtain is further movable selectively to a second open position, the first open position is between the closed position and the second open position, the bracket is in the displaced position when the curtain is in the second open position.

4. The door of claim 1, wherein the bracket is in the normal position when the curtain is in the closed position.

5. A door for selectively blocking and unblocking a passageway, the door comprising:

a frame to be adjacent the passageway;

a curtain moveable selectively to a closed position and a first open position, the curtain blocking the passageway in the closed position, and the curtain unblocking the passageway in the first open position;

a bracket to be attached to the frame, the bracket being movable selectively to a normal position and a displaced position relative to the frame;

a switch to be attached to the bracket and in sensing relationship with the curtain, the curtain supporting at least some weight of the bracket when the bracket is in the displaced position, the curtain supporting no weight of the bracket when the bracket is in the normal position;

a carrier to be disposed on the curtain;

a switch actuator to be disposed on the carrier, the switch actuator being selectively positioned in substantial alignment with the switch and in misaligned relationship with the switch; and an alignment member to extend from the bracket, the alignment member engaging the carrier when the curtain is in the first open position, and the alignment member being spaced apart from the carrier when the curtain is in the closed position.

6. The door of claim 5, wherein the carrier includes a tapered lead-in guide surface that becomes in sliding engagement with the alignment member as the curtain approaches the first open position from the closed position.

7. The door of claim 6, wherein the tapered lead-in guide surface defines a groove in the carrier.

8. A door for selectively blocking and opening a passageway, the door comprising:

a frame to flank the passageway;

a motorized drive unit;

a curtain to be coupled to and driven by the motorized drive unit to selectively block and open the passageway, the curtain having a lateral edge and a leading edge, the lateral edge extending lengthwise along the frame when the curtain is blocking the passageway, the leading edge being substantially perpendicular to the lateral edge, the leading edge being movable selectively to a first position, a second position and a third position, the first position being between the second position and the third position;

a bracket to be mounted proximate the frame;

a switch to be supported by the bracket, at least one of the bracket or the switch being movable selectively to a normal position and a displaced position relative to the frame, the switch having a normal state and a triggered state;

a carrier to be attached to the curtain;

a switch actuator to be disposed on the carrier, the switch actuator being selectively positioned in substantial alignment with the switch and in misaligned relationship with the switch, the switch actuator being misaligned when the leading edge of the curtain is at the third position, the switch actuator being substantially aligned when the leading edge is at the first position, the switch actuator being substantially aligned when the leading edge is at the second position, the switch being in the normal state when the switch actuator is misaligned with the switch, the switch being in the triggered state when the switch actuator is substantially aligned with the switch; and an alignment member to protrude from at least one of the bracket or the switch, the alignment member being spaced apart from the carrier and the switch actuator when the leading edge of the curtain is at the third position, the alignment member engaging at least one of the carrier or the switch actuator when the leading edge is at the first position, the alignment member engaging at least one of the carrier or the switch actuator when the leading edge is at the second position, the alignment member and the switch actuator being movable substantially in unison relative to the frame as the leading edge of the curtain moves between the first position and the second position.

9. The door of claim 8, wherein the passageway is substantially open when the leading edge of the curtain is at the first position.

10. The door of claim 8, wherein the passageway is substantially blocked by the curtain when the leading edge is at the first position.

11. The door of claim 8, wherein the passageway is partially open when the leading edge of the curtain is at the first position.

12. The door of claim 8, wherein the carrier includes a tapered lead-in guide surface that becomes in sliding engagement with the alignment member as the leading edge of the curtain approaches the first position from the third position.

13. The door of claim 12, wherein the tapered lead-in guide surface defines a groove in the carrier.

14. The door of claim 8, wherein the frame provides a guide track that guides the curtain as the leading edge of the curtain moves between the third position and the first position.

15. The door of claim 8, wherein the switch is a proximity switch that remains spaced apart from the switch actuator regardless of whether the leading edge of the curtain is at the first position, at the second position, or at the third position.

16. The door of claim 8, wherein the leading edge of the curtain has a first full travel range that is greater than a second full travel range of the switch.

17. The door of claim 8, wherein at least one of the bracket or the switch move under impetus of the motorized drive unit.

18. The door of claim 8, wherein the curtain supports more weight of the switch when the leading edge of the curtain is at the second position than when the leading edge is at the third position.

19. The door of claim 8, wherein the curtain supports at least some weight of the switch when the leading edge of the curtain is at the second position, and the curtain supports no weight of the switch when the leading edge is at the third position.

20. The door of claim 8, wherein the alignment member has an intact configuration and a broken configuration, the leading edge of the curtain is further movable to an overshot position, the second position is between the first position and the overshot position, the alignment member changes from the intact configuration to the broken configuration in response to the leading edge moving from the second position to the overshot position.

21. The door of claim 20, wherein the alignment member is a shear pin.

22. The door of claim 8, wherein the bracket is biased toward the normal position.

23. The door of claim 8, further including a spring that biases the bracket toward the normal position.

* * * * *